United States Patent [19]

Read, Jr.

[11] 4,072,918

[45] Feb. 7, 1978

[54] BISTABLE ELECTROMAGNETIC ACTUATOR

[75] Inventor: Reginald A. Read, Jr., Brookfield, Ill.

[73] Assignee: Regdon Corporation, Brookfield, Ill.

[21] Appl. No.: 746,338

[22] Filed: Dec. 1, 1976

[51] Int. Cl.[2] ..... H01F 3/12; H01F 7/08

[52] U.S. Cl. ..... 335/236; 335/174; 335/234

[58] Field of Search ..... 335/236, 237, 238, 229, 335/230, 231, 232, 233, 234, 295, 174

[56] References Cited

U.S. PATENT DOCUMENTS

| | | | |
|---|---|---|---|
| 3,693,122 | 9/1972 | Willard | 335/174 |
| 3,755,766 | 8/1973 | Read, Jr. | 335/229 |
| 3,944,957 | 3/1976 | Kotos et al. | 335/229 |

*Primary Examiner*—Harold Broome

*Attorney, Agent, or Firm*—Neuman, Williams, Anderson & Olson

[57] ABSTRACT

An actuator having an armature plate urged to a stable position by a spring and which may be held in another stable position by a permanent magnet. Application of an appropriate current pulse to a coil within the actuator reduces the flux flow through and the magnetic force on the armature sufficiently to release the armature to the former stable position under the influence of the spring. Two magnetic circuits, one of which includes a non-working air gap, are employed, the non-working air gap serving to maintain a flux path, of a predetermined maximum reluctance, for the permanent magnet when the armature plate is in the former stable position.

13 Claims, 2 Drawing Figures

BISTABLE ELECTROMAGNETIC ACTUATOR

This invention relates generally to the field of electromagnetic actuators and, more specifically, to electromagnetic actuators having armatures movable between either of two stable positions.

In modern remote sensing and control applications, e.g., process control, it is often necessary to convert an electrical impulse into a mechanical action. For this purpose, electromagnetic actuators have been adapted to convert electrical information, e.g., a DC pulse, into movement of a linkage connected to an armature of the actuator. Particularly advantageous, are electromagnetic actuators, wherein one stable state is maintained by a permanent magnet, thereby reducing the power consumption of the actuator. Exemplary of such prior art actuators are those shown in U.S. Pat. No. 2,915,681 issued to G. P. Troy on Dec. 1, 1959, U.S. Pat. No. 3,755,766 issued to R. A. Read, Jr., on Aug. 28, 1973, and Swiss Pat. No. 395,271 issued Dec. 31, 1965.

This invention is an improvement over the abovementioned Pat. No. 3,755,766 to R. A. Read, Jr., it being an object of this invention to provide an electromagnetic bistable actuator of improved operational and structural characteristics, employing a first magnetic circuit adapted for maximizing flux flow through an armature and a second magnetic circuit adapted to maintain magnetization of a permanent magnet.

This and other objects and features of this invention will become apparent upon a reading of the following detailed description of an illustrative embodiment in combination with the attached drawings.

In one illustrative embodiment of this invention, a substantially cylindrical, hollow housing of highly magnetically permeable material, closed at one end has a permanent magnet mounted adjacent that end axially aligned with the housing. Adjoining the distal end of the magnet is an axially aligned magnetic shunt wafer of highly permeable material forming a gap with the inner wall of the housing; this gap completes a flux circuit of a predetermined maximum reluctance for maintaining the magnetization of the magnet. Adjoining the wafer is an axially aligned core and coil assembly, the core extending substantially beyond the coil; an annular pole piece, in magnetic contact with the housing, is positioned about the extending portion of the core and forms a gap between an inner surface of the pole piece and the core. An armature is movable into a first position for magnetically bridging this gap. In such position, a low reluctance magnetic circuit is formed consisting of the housing, including the closed end, and the pole piece, armature, core, shunt wafer and magnet; this magnetic circuit effectively magnetically shorts the gap between the housing and the shunt wafer and promotes maximum flux flow since it is free of materials, such as are used for bearings, of low permeability. Upon application of a current pulse, of appropriate amplitude and direction, to the coil, flux flow through and magnetic force upon the armature are sufficiently reduced that the armature is moved under the influence of a compression spring to a second position.

For a more specific understanding of this invention, reference should now be had to the drawings attached hereto, illustrating a preferred and an alternative embodiment serving as examples of the invention.

IN THE DRAWINGS

DETAILED DESCRIPTION OF THE ILLUSTRATIVE EMBODIMENT

Figure 1:
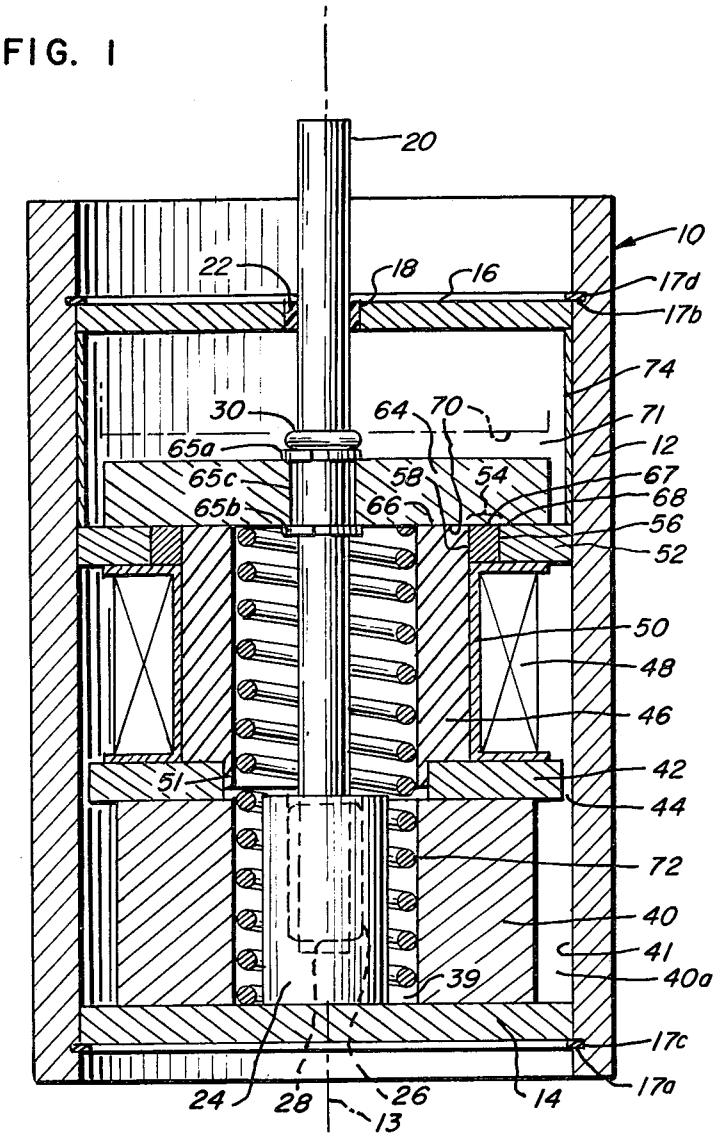
FIG. 1 shows a sectional view of a preferred illustrative embodiment of this invention.

Referring to FIG. 1, an electromagnetic actuator according to this invention is shown generally at 10 and includes a housing 12 of highly magnetically permeable material, being of hollow, substantially cylindrical form with an axis 13 and being closed at the lower end (as seen in FIG. 1) by a wall 14 and at the upper end by a wall 16. The wall 14 is also of highly magnetically permeable material; however, the wall 16 may be of any structurally suitable material, including material of low magnetic permeability. In the preferred embodiment, the wall 16 is of the same material as the housing 12, e.g., iron. The walls 14 and 16 may be secured to the housing by any suitable means well known to those skilled in the art to which this invention pertains, e.g., staking, cement, etc.; however, in the case of wall 14, close magnetic contact (low reluctance) with housing 12 must be maintained. In the preferred embodiment internal retaining rings 17*a* and 17*b* are disposed in grooves 17*c* and 17*d*, respectively, in the housing 12 adjoining outer surfaces of the walls 14 and 16, respectively, to retain such walls within the housing.

Disposed along the axis of the housing 12 and passing through a hole 18 in the end wall 16 is an armature connecting rod 20 of a structurally suitable material such as nonmagnetic stainless steel of relatively low magnetic permeability. The rod 20 slideably engages a bearing insert 22, of nylon or other material appropriate for faclitating sliding movement of rod 20, suitably mounted, e.g., by cement, within the hole 18 of the wall 16. The distal end of the rod 20 is disposed within a guide 24 of nonmagnetic material and substantially cylindrical shape suitably mounted by a bolt (not shown) to the wall 16. The guide 24 includes an axially aligned hole 26 in which a bearing 28 is mounted in an appropriate manner (e.g., cement or press fit); the rod 20 slideably engages bearing 28 and, thus, may move reciprocally within the housing 12 along the axis of that housing. It should be noted, however, that an O-ring 30 is mounted on the rod 20 at a predetermined position along the rod beneath the wall 16 for the purpose of limiting travel of the rod 20, and serving as a bumper to absorb forces attendant to the reciprocation of the rod 20 in the housing.

Connected in close magnetic contact to the bottom wall 14 by cement or other suitable means, is a cylindrical permanent magnet 40 axially aligned with the principal axis 13 of the housing 12 and forming a substantial gap 40*a* with an inner wall 41 of the housing. This magnet is preferably formed of a material having a high magnetic remanence such as Alnico V or the like. Adjoining the distal end of the magnet 40 and secured by cement or other suitable means in close magnetic contact therewith, is a cylindrical shunt wafer 42 axially aligned with the axis 13 of the housing 12. The shunt wafer is of a maximum diameter appropriate to form what may be referred to as a "non-working gap" 44, less than the gap 41, between its extreme outer surface and the inner wall of the housing 12. The shunt wafer is formed of highly magnetically permeable material.

Adjoining the shunt wafer in close magnetic contact therewith is a coil core 46 axially aligned with the axis 13 and having wound about it a coil 48 on a coil form 50; leads (not shown) to the coil 48 are accessible exteriorly of the housing 12. It should be noted that the core 46 is of highly magnetically permeable material and extends axially substantially beyond the coil 48 and form 50; further, an apron 51 of the core 46 extends downwardly within the wafer 42. A pole piece 52 of highly magnetically permeable material and annular shape adjoins an end of the coil form 50, which is of relatively low permeability, and engages, in close magnetic contact, the inner wall 41 of the housing 12. A gap 54 is formed between an inner surface 56 of the pole piece and an outer surface 58 of that portion of the core 46 extending as aforesaid beyond the coil form 50. The gap 54 may be referred to as a "working gap". Various materials may be used in this gap, including air; in the preferred embodiment, nonmagnetic (low permeability) stainless steel or brass is used.

An armature plate 64 is secured by external C-rings **65*a* and 65*b* to the rod 20, which passes through a hole 65*c* in the plate 64; the hole 65*c* is slightly larger in diameter than the diameter of the rod 20. The plate 64 is axially aligned with and disposed along the rod 20 to be movable with the rod 20 to a first position as shown in FIG. 1 wherein it is in close magnetic contact with an end surface 66 of the core 46, and an end surface 67 of the working gap 54, and an end surface 68 of the pole piece 52. In the preferred embodiment all of the above-mentioned end surfaces are substantially coplanar. In fact, in the preferred embodiment to ensure satisfactory magnetic contact of the end surfaces 66, 67, and 68 with an undersurface 70 of the armature plate 64, the core 46, working gap 54 (of stainless steel or brass) and pole piece 52 are brazed together and the end surfaces 66, 67, and 68 are ground coplanar. Further, the C-rings 65*a* and 65*b* engage appropriate grooves (not shown) in rod 20; they are spaced slightly further apart than the thickness of the armature plate 64 to allow the armature plate some freedom to align the surface 70 with the aforesaid end surfaces in the event the end surfaces and axis of the rod 20** are not precisely perpendicular to one another.

Here it should be noted that the magnet 40, the shunt wafer 42, and the core 46 are all annular, in the preferred embodiment, permitting a helical compression spring 72, of nonmagnetic material, to be positioned axially aligned with the housing and disposed at least partially within the magnet 40, wafer 42 and core 46. The spring engages the bottom wall 14 and the surface 70 of the armature plate 64; a recess (not shown) in the surface 70 may be provided to receive the end of the spring. Spring 72 urges the armature plate 64 to a second position where the surface 70 is substantially displaced from the surfaces 66, 67 and 68 forming a gap 71, shown in phantom in FIG. 1, therebetween. The extent of this displacement of the armature may be determined by the rest (noncompressed) position for the spring 72 or the engagement of the ring 30 with the wall 16. In the preferred embodiment, engagement of the O-ring 30 with wall 16 is determinative of the second position displacement, and the spring 72 remains sufficiently compressed in such second position to ensure that the orientation of the actuator in the gravity field has no substantial effect on the operation of the actuator.

A cylindrical spacer 74 of nonmagnetic material is positioned adjoining the inner wall 41 of housing 12 between wall 16 and pole piece 52. The spacer 74 serves to separate the assembly of parts including the pole piece 52, core 46, wafer 42 and magnet 40 from the wall 16. Thus, all of these components, the spacer 74 and walls 14 and 16 cooperatively operate with the rings **17*a* and 17*b*** to fix the longitudinal placement of such components with respect to the housing.

While cement may be used to secure from lateral displacement a component, such as the wafer 42, which does not engage the walls of the housing 12, spacers of nonmagnetic material may also be used for such purpose.

In operation, the armature plate 64 is maintained in the position shown in FIG. 1 under the influence of magnetic force generated by flux flow induced by the magnet 40, after such magnet is properly magnetized. This flux passes from the magnet 40 through the shunt wafer 42 and the core 46, the armature plate 64, the pole piece 52, housing 12 and wall 14 and returns to the magnet 40. The force exerted by compression spring 72 on the surface 70 of the armature plate 64 is insufficient to overcome the magnetic force on the armature resulting from this flow of flux through the armature induced by the magnet 40. This flux flow is maximized by the presence in this magnetic circuit of only highly permeable materials.

The armature plate 64 may be moved to a second position as above mentioned, with the surface 70 positioned as shown in phantom in FIG. 1, by application of force upwardly on the rod 20 or by application of an appropriate pulse of current to the coil 48. In the event of application of such a pulse to the coil 48 in a direction such as to reduce the net flow of flux through the armature plate 64, the magnetic force on that armature becomes less than the force applied by the spring 72 and the armature is moved upwardly; the rod 20 moves with the armature, as does any external linkage (not shown) which may be connected thereto. Thereafter, with the armature plate in its second position in the preferred embodiment, the air gap 71, thus formed beneath the armature surface 70, is sufficiently greater than the gap 44 that the bulk of the flux flow is through the nonworking air gap 44. As a result, the flux flow through the armature 64 is at a sufficiently reduced level, even after the current pulse to the coil 48 is terminated, that the net magnetic force on the armature is less than the force of the spring 72. Consequently, the armature plate 64 is stable in the second position.

In an appropriate configuration of the actuator 10 with adequate coil 48 windings and adequate current applied so as to sufficiently increase the net flux flow through the armature 64, a magnetic force could be developed which would overcome the force of the spring 72 and return the armature plate 64 from its second stable position to its first stable position. Thereafter, termination of the current pulse through the coil 48 would leave the armature plate 64 firmly held in the first stable position under the influence of magnetic force developed by flux flow induced by the magnet 40 alone. In the preferred embodiment, however, actuator 10 is intended only for release from the first stable position to the second stable position either manually or through the application of an appropriate DC pulse; the actuator is reset manually by applying a force on the rod 20 in a downward direction as viewed in FIG. 1.

As mentioned above a second magnetic circuit is provided in the above-described structure, that magnetic circuit being from the magnetic 40 through the shunt wafer 42, the gap 44, the housing 12 and the wall 14. This second magnetic circuit is provided to maintain a flux path having no more than a predetermined maximum reluctance for flow induced by the magnet 40. This serves to preserve at least a minimum level of magnetization of the aforementioned magnet 40 which may be of Alnico V material. Absent such a secondary flux path for the magnet, the magnetization of the Alnico V type magnet would diminish greatly when subjected to high reluctance following the first transition of the armature plate 64 from the first stable position to the second; the diminution of magnetization could well be so much as to render the magnet induced flux flow incapable of stably holding the armature plate 64 in the first position against the force of spring 72. In this regard, it should be noted that the armature 64 in its first stable position effectively magnetically shorts not only the working gap 54 but also the non-working gap 44.

Figure 2:
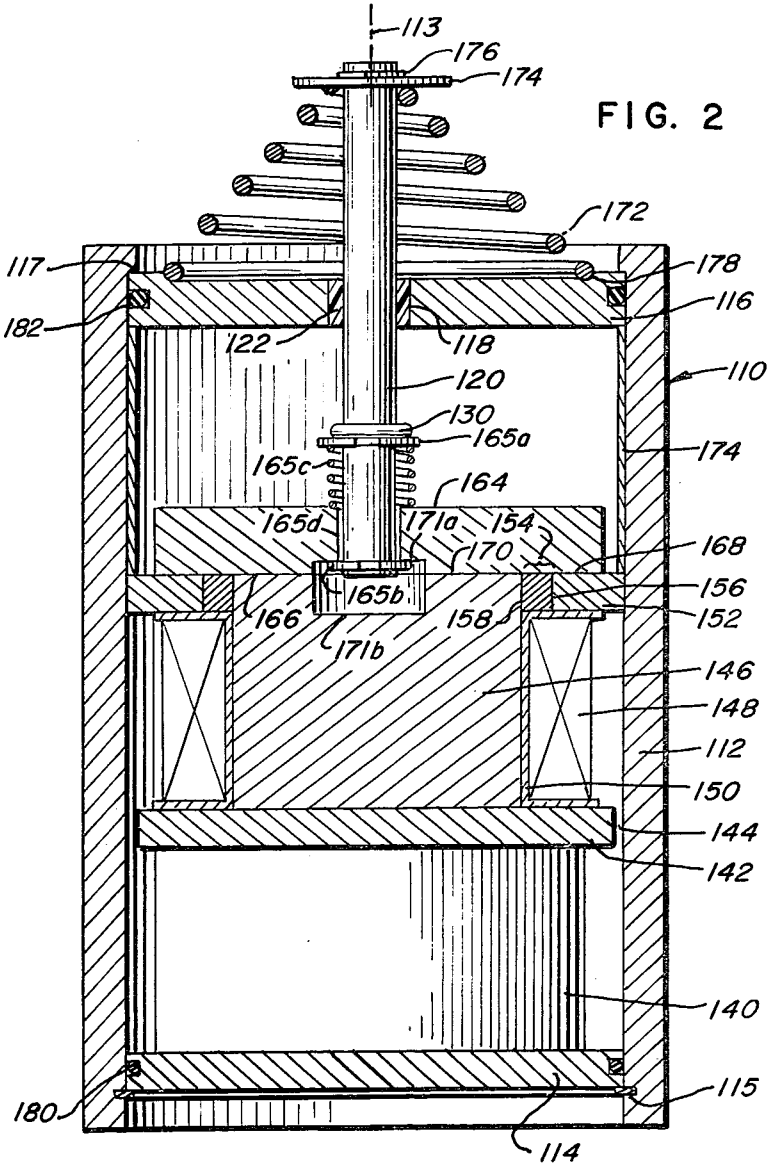
FIG. 2 shows a sectional view of an alternative illustrative embodiment of this invention.

An alternative structure for an electromagnetic actuator embodying principles of this invention is shown in FIG. 2 as actuator 110 having a housing 112. End walls 114 and 116 engage a "C" retaining ring 115 and a rib 117 in the housing 112, respectively. The wall 116 is preferred to be constructed of the same material as the casing 112 to provide adequate structural integrity for the application of forces aligned axially with the axis 113 of the actuator 110. A hole 118 is provided axially aligned with the actuator 110 through which a rod 120 passes, sealingly and slideably engaging a bearing 112 mounted appropriately within the hole 118; a bumper O-ring 130 is disposed along the rod 120.

A magnet 140 is positioned in close magnetic contact with the wall 114 and axially aligned with the actuator. A cylindrical shunt wafer 142 is secured to the distal end of the magnet 140 and a gap 144 is formed between the wafer 142 and the inside surface of the cylindrical housing 112. A core and coil assembly including a core 146, a coil 148 and coil form 150 is secured to the upper surface, as viewed in FIG. 2, of the wafer 142. The core 146 extends substantially beyond the coil form 150; annularly disposed about the extending portion of core 146 is a pole piece 152 in magnetic contact with the housing 112 and forming a gap 154 between its inner surface 156 and an outer surface 158 of the core 146. The gap contains nonmagnetic stainless steel or brass. A spacer 174 is provided to maintain the relative positions of the aforementioned components from the end wall 116.

Connected to an end of the rod 120 by means of C-rings **165*a* and 165*b* and nonmagnetic compression spring 165*c* is an armature plate 164. The ring 165*a* adjoins the bumper O-ring 130 and serves to retain one end of the spring 165*c*, the other end of which engages the plate 164. A hole 165*d* in the plate 164 for the rod 120 is slightly larger in diameter than the rod 120. The armature plate 164, so connected to rod 120, is disposed for engaging an end surface 166 of the core 146 and an end surface 168 of the pole piece 152 with an undersurface 170 as viewed in FIG. 2 of the armature plate 164. The undersurface 170 includes a recess 171*a* in which an end of the rod 120 and the C-ring 121*b* are positioned. Further a recess 171*b* is provided in surface 166 and is adapted to receive a portion of rod 120 and ring 121*b***.

A conical, spiral compression spring 172 is disposed exteriorly of the actuator 110, its larger diameter end engaging an upper surface of the wall 116 and its smaller diameter end engaging a washer 174 connected to the distal end of the rod 120 by a C-ring 176. All or a portion of the spring 172 engaging the wall 116 may be depressed in a recess 178 centered about the axis of the actuator 110.

Sealing members 180 and 182 in walls 114 and 116, respectively, cooperatively operate with housing 112 to seal the actuator against contamination from without the actuator. It should be noted that such sealing members may also be employed in similar fashion in the actuator 10 (FIG. 1).

The operation of the actuator 110 (FIG. 2) is similar to that of the actuator 10 previously described. It should be noted that the conical, spiral spring 172 cooperatively operates with the bearing 122 in establishing the axis of translation of the rod 120 along the axis of the actuator 110. However, the axis of translation for rod 120 may also be established by the bearing 122 alone, provided such has sufficient surface in contact with the rod 120. Moreover, a conventional cylindrical, helical spring may be employed in place of spring 172 as long as the axis of translation of rod 120 is adequately established as above described or alternatively by modifying the housing extending above wall 116 to include a second bearing for further fixing the axis of translation of the rod 120. Further, the spring mounting, including ring **165*a* and spring 165*c*, for plate 164 on rod 120 together with the oversized hole 165*d* in plate 164 promotes alignment of the surface 170 in close contact with surfaces 166 and 168** and absorbs impact forces attendant to resetting the actuator.

The above description is directed to a specific, preferred, and an alternative, illustrative embodiment of this invention. It is not intended, however, that the invention be limited to the illustrative embodiments; rather, those skilled in the art to which this invention pertains will recognize numerous additional embodiments of the principles of this invention upon reading this disclosure. Therefore, it is intended to encompass within this invention all those embodiments within the true spirit and scope of the following claims.

What is claimed is:

1. Magnetic apparatus comprising:

a hollow housing of highly magnetically permeable material, having a principal axis and an inner wall, said housing being closed at one end;

a magnet in in close magnetic contact with said closed end of said housing, and substantially axially aligned with said principal axis, said magnet forming a gap of at least a first dimension with said inner wall;

a shunt piece, of highly magnetically permeable material, in close magnetic contact with said magnet and substantially axially aligned with said principal axis, said shunt piece forming a gap with said inner wall of substantially a second dimension, said second dimension being less than said first dimension;

a coil;

a core, of highly permeable magnetic material, in close magnetic contact with said shunt piece and substantially axially aligned with said principal axis, said coil being disposed about said core and said core including a portion extending axially beyond said coil;

a pole piece, of highly magnetically permeable material, disposed adjacent said coil and about that portion of said core extending beyond said coil, in close magnetic contact with said inner wall of said housing and forming a gap between an inner surface of said pole piece and said portion of said core;

armature means, including an armature plate, of highly magnetically permeable material, disposed for reciprocal movement in said housing between first and second positions, along said principal axis, said plate being disposed to overlie, in close magnetic contact, said core and said pole piece in said first position, and to have a gap of at least a third dimension with at least one of said pole piece and said core in said second position; and means for urging said armature plate to said second position.

2. Apparatus as in claim 1 wherein said magnet, shunt piece and core are annular in form and said means for urging said armature plate to said second position is of material of low magnetic permeability and is disposed at least partially within said magnet, shunt piece and core.

3. Apparatus as in claim 2 wherein said armature means further comprises a rod of material of low magnetic permeability, means for connecting said rod to said armature plate, and means for substantially aligning said rod with said principal axis of said housing for reciprocating movement therein.

4. Apparatus as in claim 3 wherein said core and said pole piece have end surfaces substantially coplanar with each other and said plate includes a substantially coplanar end surface, said means for connecting said rod to said armature plate permitting said end surface of said armature plate to engage, in close magnetic contact, said end surfaces of said core and said pole piece when said armature plate is in said first position.

5. Apparatus as in claim 4 wherein said means for connecting said rod to said armature plate permits limited variation of the orientation of said armature plate with respect to said rod to promote close magnetic contact between said end surface of said armature plate and said end surfaces of said pole piece and core.

6. Apparatus as in claim 1 wherein said armature means further comprises a rod of material of low magnetic permeability, means for connecting said rod to said armature plate, and means for substantially aligning said rod with said principal axis of said housing for reciprocating movement therein.

7. Apparatus as in claim 6 wherein said core and said pole piece have end surfaces substantially coplanar with each other and said plate includes a substantially coplanar end surface, said means for connecting said rod to said armature plate permitting said end surface of said armature plate to engage, in close magnetic contact, said end surfaces of said core and said pole piece when said armature plate is in said first position.

8. Apparatus as in claim 7 wherein said means for connecting said rod to said armature plate permits limited variation of the orientation of said armature plate with respect to said rod to promote close magnetic contact between said end surface of said armature plate and said end surfaces of said pole piece and core.

9. Apparatus as in claim 8 wherein said means for urging said armature plate to said second position comprises a spring connected to said rod.

10. Apparatus as in claim 9 wherein said spring is a conical, spiral spring connected to said rod at an end of said rod distal from said armature plate.

11. Apparatus as in claim 10 wherein said housing is closed at its other end and further comprising means for sealing said ends of said housing.

12. Apparatus as in claim 11 wherein said means for connecting said rod to said armature plate comprises a compression spring and means for retaining said spring in engagement with said plate.

13. Apparatus as in claim 6 wherein said means for connecting said rod to said armature plate comprises a compression spring and means for retaining said spring in engagement with said plate.

* * * * *